US012428744B2

(12) United States Patent
Wu et al.

(10) Patent No.: US 12,428,744 B2
(45) Date of Patent: Sep. 30, 2025

(54) NICKEL ELECTROPLATING COMPOSITIONS FOR ROUGH NICKEL

(71) Applicant: Rohm and Haas Electronic Materials LLC, Marlborough, MA (US)

(72) Inventors: Weigang Wu, Hung Hom (HK); Fai Lung Ting, Solaris Kallang (SG)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

(21) Appl. No.: 18/466,391

(22) Filed: Sep. 13, 2023

(65) Prior Publication Data

US 2024/0124999 A1 Apr. 18, 2024

Related U.S. Application Data

(60) Provisional application No. 63/409,947, filed on Sep. 26, 2022.

(51) Int. Cl.

| | |
|---|---|
| ***C25D 3/18*** | (2006.01) |
| ***C25D 3/12*** | (2006.01) |
| ***C25D 5/00*** | (2006.01) |

(52) U.S. Cl.

CPC ..... *C25D 3/18* (2013.01); *C25D 3/12* (2013.01); *C25D 5/605* (2020.08)

(58) Field of Classification Search

None

See application file for complete search history.

(56) References Cited

U.S. PATENT DOCUMENTS

| | | | | |
|---|---|---|---|---|
| 4,384,929 | A | 5/1983 | Tremmel et al. | |
| 4,549,942 | A * | 10/1985 | Tremmel | C25D 3/18 205/279 |
| 7,190,057 | B2 | 3/2007 | Seki et al. | |
| 7,285,845 | B2 | 10/2007 | Kang et al. | |
| 8,937,378 | B2 | 1/2015 | Paek et al. | |
| 9,171,789 | B2 | 10/2015 | Shin et al. | |
| 2020/0141009 | A1* | 5/2020 | Nanbu | C23C 28/36 |
| 2020/0347503 | A1 | 11/2020 | Engelhardt et al. | |
| 2023/0203693 | A1* | 6/2023 | Chun | H05K 3/188 428/209 |
| 2024/0117516 | A1 | 4/2024 | Wu et al. | |

FOREIGN PATENT DOCUMENTS

| | | | | |
|---|---|---|---|---|
| CA | 1255620 | A | 6/1989 | |
| CN | 100475685 | | 4/2009 | |
| JP | 1171257 | A | 7/1989 | |
| JP | 01222064 | A * | 9/1989 | C23C 18/34 |
| JP | 2001192848 | A * | 7/2001 | |

(Continued)

OTHER PUBLICATIONS

Iwamatsu et al. (JP2001192848A, machine translation). (Year: 2001).*

(Continued)

*Primary Examiner* — Wojciech Haske

(74) *Attorney, Agent, or Firm* — Jonathan D. Baskin

(57) ABSTRACT

Nickel electroplating compositions containing thiourethanes deposit rough nickel on substrates. The rough nickel can be electroplated over wide current density ranges. The rough nickel deposits enable improved adhesion to other metal layers in contrast to many conventional nickel deposits.

14 Claims, 2 Drawing Sheets

(56) References Cited

FOREIGN PATENT DOCUMENTS

| | | |
|---|---|---|
| JP | 2016094659 A | 5/2016 |
| WO | 2022085464 A1 | 4/2022 |

OTHER PUBLICATIONS

JP-01222064-A, machine translation). (Year: 1989).*
Search report for corresponding EP Application No. 23199597.8 dated Feb. 27, 2024.
Hang, Study on the Adhesion Between Epoxy Molding Compound and Nanocone-Arrayed Pd Preplated Leadframes; Journal of Electronic Materials, 2007, vol. 36, No. 12.
Ni, Adhesion Improvement of Epoxy Molding Compound—Pd Preplated Leadframe Interface Using Shaped Nickel Layers, Microelectronics Reliability, 2012, 52, pp. 206-211.

* cited by examiner

NICKEL ELECTROPLATING COMPOSITIONS FOR ROUGH NICKEL

FIELD OF THE INVENTION

The present invention is directed to nickel electroplating compositions for depositing rough nickel on a substrate. More specifically, the present invention is directed to nickel electroplating compositions for depositing rough nickel on a substrate, wherein the nickel electroplating compositions include a thiourethane.

BACKGROUND OF THE INVENTION

Leadframes are used to mount and process semiconductor dice or chips in the production of semiconductor devices. The leadframe acts to electrically connect the chip to external devices via leads of the leadframe. Examples of leadframes include spot silver and solder-coated leadframes and palladium preplated leadframes (PPF).

PPF is a three-layered leadframe containing nickel having a thickness range of 0.5-2 μm, palladium having a thickness range of 10-100 nm and gold having a thickness of 3-9 nm. The nickel layer is used to prevent copper diffusion from the leadframe bulk into the palladium layer, and as a ground layer joining with the solder. While the palladium layer functions to prevent nickel surface oxidation and gold diffusion into the nickel layer, the upper gold flash layer is designed to prevent palladium oxidation and outgas absorbed by palladium.

Semiconductor chips are mounted onto the leadframe and the bonding wire connections are made between the semiconductor chips and the leadframe. Each semiconductor chip is protected from the environment by encapsulating with a plastic molding compound, which is also called epoxy molding compound (EMC). Good adhesion between the leadframe and EMC is critical to high reliability and to secure proper functioning of interconnect circuit (IC) devices. Poor adhesion can result in delamination, cracking and the "popcorn" phenomena. This results in device failure, particularly under the harsh conditions such as at high temperatures, high humidity and thermal cycling.

To avoid the delamination of epoxy molding compounds from leadframes or substrates, there are many different methods known in the art. Such methods include utilizing special leadframe design, chemical bonding and mechanical interlocks. Special leadframe designs include holes, grooves and semi-spheres, made mechanically or by laser application on the leadframe surface. Such methods may not enable the high reliability or meet the MSL-1 compliance (moisture sensitivity level-1, 85° C. and 85% relative humidity for 168 hours, IPC/JEDEC J-STD-20) to achieve industry standards of adhesion between EMC and the leadframe.

Chemical bonding techniques include brown oxide, organic adhesion promoter, polymer primer and coupling agent. The mechanism is that the brown oxide and organic adhesion have one or two functional groups that link with EMC and the leadframe. Accordingly, adhesion is enhanced by chemical bonding. In the brown oxide method copper on the surface of the substrate is oxidized to cupric oxide or cuprous oxide. However, the brown oxide method cannot be applied to Ni/Pd/Au pre-plated leadframes since no copper surface is exposed. Furthermore, the micro-etching effect in brown oxide treatment weakens the leadframe strength and may result in dimension variation.

Organic treatments have some limitations which hinder its widespread use in mass production. For example, there may be compatibility issues with organic adhesion promoters with various types of EMC. Method steps can be complicated for polymer primers. Copper-coupling agents may encounter hydrolysis under usual packaging conditions.

The gold and palladium layers of PPF (Ni/Pd/Au) leadframes are substantially inert metals, therefore it is hard to enhance mold adhesion by modifying chemical bonding. The only feasible means is to utilize a mechanical interlocking effect by roughening the copper or nickel substrate surface. Palladium and gold layers are too thin to be roughened in the fabrication process.

U.S. Pat. Nos. 7,190,057 and 7,285,845 disclose nickel plating baths which deposit rough nickel layers to improve adhesion between the nickel layers and resin sealing in semiconductor packaging. The '057 patent discloses a nickel plating bath of nickel chloride, sodium thiocyanate and ammonium chloride to provide a rough nickel deposit. The '845 patent discloses a nickel plating bath which includes nickel sulfate, ammonium sulfate, sodium sulfate, sodium chloride and boric acid to deposit a rough nickel layer.

Although there are nickel baths which deposit rough nickel, there is still a need for an improved nickel electroplating bath which enables deposition of rough nickel.

SUMMARY OF THE INVENTION

The present invention is directed to nickel electroplating compositions including nickel ions and a compound having a formula:

(I)

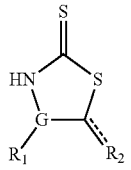

wherein $R_1$ and $R_2$ are independently chosen from hydrogen, linear or branched $(C_1\text{-}C_6)$alkyl, linear or branched hydroxy $(C_1\text{-}C_6)$alkyl, linear or branched carboxy$(C_1\text{-}C_6)$alkyl, linear or branched amino$(C_1\text{-}C_6)$alkyl, $(C_5\text{-}C_6)$cycloalkyl ring, or $R_2$ can be sulfur, and G is carbon or nitrogen, and salts of the thiourethanes, the nickel electroplating composition is free of alloying metals.

The present invention is also directed to methods of electroplating nickel metal on a substrate including:

a) providing the substrate;

b) contacting the substrate with a nickel electroplating composition including nickel ions and a compound having the formula:

(I)

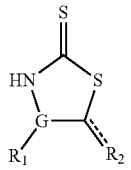

wherein $R_1$ and $R_2$ are independently chosen from hydrogen, linear or branched $(C_1\text{-}C_6)$alkyl, linear or branched hydroxy$(C_1\text{-}C_6)$alkyl, linear or branched carboxy$(C_1\text{-}$ $C_6$)alkyl, linear or branched amino($C_1$-$C_6$)alkyl, ($C_5$-$C_6$)cycloalkyl ring, or $R_2$ can be sulfur, and G is carbon or nitrogen, and salts of the thiourethanes, the nickel electroplating composition is free of alloying metals; and c) depositing a nickel layer on the substrate, wherein the nickel layer comprises a Sa≥70 nm and a Sdr≥4%.

The nickel electroplating compositions of the present invention enable deposition of rough nickel layers having substantially granular or cobblestone type morphology. The rough nickel enables improved adhesion between the rough nickel layer and adjacent metal layers as well as improving mold adhesion force with epoxy molding compounds as found in leadframes.

DETAILED DESCRIPTION OF THE INVENTION

Figure 1:
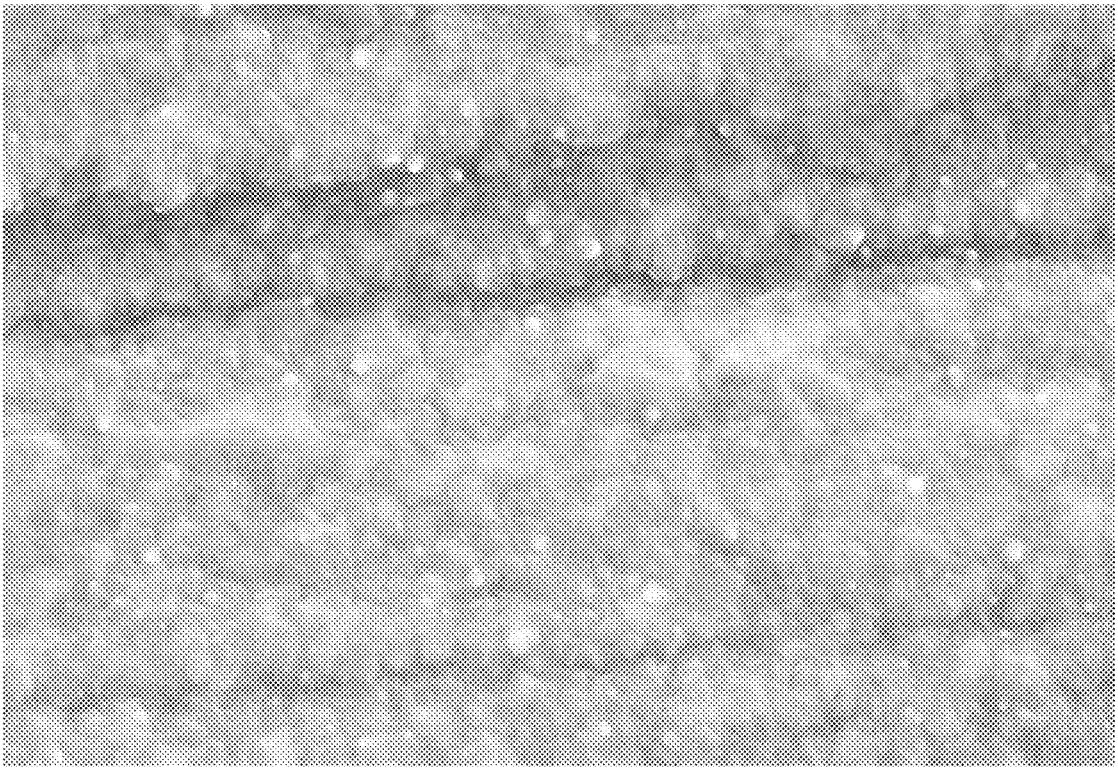
FIG. 1 is a SEM at 10,000× of a conventional nickel layer having a substantially smooth surface.

As used throughout the specification the abbreviations have the following meanings, unless the context clearly indicates otherwise: ° C.=degrees Centigrade; g=gram; Kg=kilograms; L=liter; mL=milliliter; m=meters; cm=centimeter; μm=microns; nm=nanometers; DI=deionized; A=amperes; ASD=amperes/$dm^2$=current density or plating speed; PPF=palladium preplated leadframes; EMC=epoxy molding compound; XRF=X-ray fluorescence; AFM=atomic force microscope; KV=kilovolts; V=volts; LPM=liters per minute; min=minute; MSL=moisture sensitivity level; MSL-1=Moisture Sensitivity Level-1, 85° C. & 85% relative humidity for 168 hours; w/o MSL-1=without MSL treatment; w/MSL-1=with MSL treatment; S=sulfur; C=carbon; Ni=nickel; Pd=palladium; Au=gold; and wt %=weight percent.

The term "thiourethane" means a chemical compound containing the functional moiety N—C(S)—S. The term "moiety" means one or more atoms which compose part of a molecule. The term "adjacent" means directly in contact with such that two metal layers have a common interface. The term "aqueous" means water or water based. The term "matte" means dull appearance. The terms "composition" and "bath" are used interchangeably throughout the specification. The term "Ra" means arithmetic mean deviation in profile roughness. The term "Sa" means arithmetical mean height within the evaluation area and is substantially equivalent to Ra, however, Sa provides more stable results because the Sa is not significantly influenced by scratches, contamination and measurement noise. The term "Sdr" means developed interfacial area ratio corresponding to surface ratio with a correlation of Sdr=(surface ratio−1)×100%. The terms "electroplating", "plating" and "depositing" are used interchangeably throughout the specification. The term "morphology" means shape, size, texture or topography of a surface or article. The term "ion" means cation or anion depending on the context used in the present specification and as would be understood by the person of ordinary skill in the art. The dashed line "------" represents an optional covalent chemical bond. The term "IPC/JEDEC J-STD-20" means Institute for Interconnecting and Packaging Electronic Circuits (IPC) and Solid State Technology Association for standard classification of moisture sensitivity levels (MSLs) of lead-frame IC devices. The terms "a" and "an" can refer to both the singular and the plural throughout the specification. All numerical ranges are inclusive and combinable in any order, except where it is logical that such numerical ranges are constrained to add up to 100%.

The present invention is directed to aqueous nickel electroplating compositions including a thiourethane having the following chemical structure:

(I)

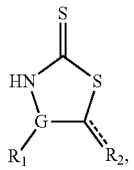

wherein $R_1$ and $R_2$ are independently chosen from hydrogen, linear or branched ($C_1$-$C_6$)alkyl, linear or branched hydroxy ($C_1$-$C_6$)alkyl, linear or branched carboxy($C_1$-$C_6$)alkyl, linear or branched amino($C_1$-$C_6$)alkyl, ($C_5$-$C_6$)cycloalkyl ring, or $R_2$ can be sulfur, and G is carbon or nitrogen, and salts of the thiourethanes.

Preferably, $R_1$ and $R_2$ are independently chosen from hydrogen, linear or branched ($C_1$-$C_6$)alkyl, linear or branched hydroxy($C_1$-$C_6$)alkyl, linear or branched carboxy ($C_1$-$C_6$)alkyl, linear or branched amino($C_1$-$C_6$)alkyl, or $R_2$ can be Sulfur, and G is carbon or nitrogen.

A preferred thiourethane compound has the formula:

(II)

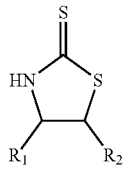

wherein $R_1$ and $R_2$ are independently chosen from hydrogen, linear or branched ($C_1$-$C_6$)alkyl, linear or branched hydroxy ($C_1$-$C_6$)alkyl, linear or branched carboxy($C_1$-$C_6$)alkyl, linear or branched amino($C_1$-$C_6$)alkyl, and G of formula (I) above is carbon.

More preferably, $R_1$ and $R_2$ of formula (I) are independently chosen from hydrogen, linear or branched ($C_1$-$C_3$) alkyl, linear or branched, hydroxy($C_1$-$C_3$)alkyl or linear, branched, carboxy($C_1$-$C_3$)alkyl, or $R_2$ is sulfur, and G is carbon or nitrogen. Further preferably, $R_1$ and $R_2$ are independently chosen from hydrogen, ($C_1$-$C_2$)alkyl, hydroxy ($C_1$-$C_2$)alkyl or carboxy($C_1$-$C_2$)alkyl, or $R_2$ is sulfur, and G is nitrogen. Even more preferably, $R_1$ is hydrogen, ($C_1$-$C_2$) alkyl, hydroxy($C_1$)alkyl or hydroxymethyl or carboxy($C_1$) alkyl or carboxymethyl, $R_2$ is sulfur, and G is nitrogen.

A most preferred thiourethane compound has the formula:

(III)

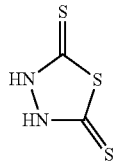

2,5-dimercapto-1,3,4-thizdiazole

Preferably, the salts of the thiourethane compounds include, but are not limited to, alkali metal salts such as sodium, potassium and lithium salts, more preferably, the salts are sodium and potassium salts, further preferably, the salts are sodium salts.

Preferably, the thiourethanes are included in the nickel electroplating compositions in amounts of 5 ppm or greater, more preferably, 10 ppm to 100 ppm, further preferably from 20 ppm to 80 ppm, even more preferably, from 30 ppm to 60 ppm, most preferably, from 45 ppm to 55 ppm.

The nickel electroplating compositions include nickel ions from one or more sources of water-soluble nickel salts. Such nickel salts include, but are not limited to, nickel sulfate and its hydrated form nickel sulfate hexahydrate and nickel sulfate heptahydrate, nickel sulfamate and its hydrated form nickel sulfamate tetrahydrate, nickel chloride and its hydrated form nickel chloride hexahydrate, nickel carbonate, nickel methane sulfonate, nickel bromide, nickel fluoride, nickel iodide, nickel oxalate, nickel citrate, nickel tetrafluoroborate, nickel hypophosphite and nickel acetate. Preferably, the source of nickel ions is nickel sulfamate, nickel chloride or mixtures thereof.

The one or more sources of nickel ions are included in the aqueous nickel electroplating compositions in sufficient amounts to provide the desired nickel ion concentrations to achieve the desired rough nickel deposit. Preferably, the concentration of nickel salts in the nickel electroplating compositions of the present invention is 20 g/L and greater. More preferably, the concentration of nickel salts is from 25 g/L to 750 g/L, further preferably, the nickel salt concentrations range from 30 g/L to 500 g/L, most preferably, from 30 g/L to 300 g/L.

Optionally, chloride ions can be included in the aqueous nickel electroplating compositions of the present invention. One or more sources of chloride ions are, preferably, included in amounts of 0 g/L to 50 g/L, more preferably, from 0 g/L to 30 g/L, further preferably, from 0 g/L to 20 g/L, most preferably, from 3 g/L to 10 g/L.

Sources of chloride ions include, but are not limited to, nickel chloride, nickel chloride hexahydrate, hydrogen chloride, alkali metal salts such as sodium chloride and potassium chloride, magnesium chloride, calcium chloride, ammonium chloride, organic hydrochloride salts including, but not limited to, guanidine hydrochloride, ethylenediamine dihydrochloride, trimethylammonium chloride, pyridine hydrochloride, phenylammonium chloride and hydrazine dihydrochloride. Preferably, the source of chloride ions is nickel chloride and nickel chloride hexahydrate.

The nickel electroplating compositions of the invention are acidic. The pH preferably ranges from 2 to 6, more preferably, from 2.5 to 4.5, even more preferably, from 3 to 4.2. Inorganic acids, organic acids, inorganic bases, organic bases and salts thereof can be used to adjust the pH of the aqueous nickel electroplating compositions. Such acids include, but are not limited to, inorganic acids such as sulfuric acid, hydrochloric acid, sulfamic acid, boric acid and salts thereof. Organic acids include, but are not limited to, organic acids such as acetic acid, amino acetic acid, ascorbic acid, lactic acid, 5-sulfosalicylic acid and salts thereof. Inorganic bases such as sodium hydroxide and potassium hydroxide and organic bases such as various types of amines and ammonium acetate can be used to adjust the pH. Preferably, the pH adjusting agents are chosen from boric acid, lactic acid, 5-sulfosalicylic acid and ammonium acetate. Most preferably, the pH adjusting agent is boric acid, salts thereof and ammonium acetate. The pH adjusting agents can be added in amounts as needed to maintain a desired pH range.

Optionally, one or more surfactants can be included in the aqueous nickel electroplating compositions of the invention. Such surfactants include, but are not limited to, ionic surfactants such as cationic and anionic surfactants, non-ionic surfactants, and amphoteric surfactants. Preferably, surfactants can be used in conventional amounts, such as 0.05 g/L to 150 g/L, more preferably, from 0.05 g/L to 15 g/L, further preferably, from 0.05 g/L to 5 g/L.

Examples of surfactants include, but are not limited to, anionic surfactants such as sodium di(1,3-dimethylbutyl) sulfosuccinate, sodium-2-ethylhexylsulfate, sodium diamyl sulfosuccinate, sodium lauryl sulfate, sodium lauryl ethersulfate, sodium di-alkylsulfosuccinates and sodium dodecylbenzene sulfonate, and cationic surfactants such as quaternary ammonium salts such as perfluorinated quaternary amines. An example of a commercially available anionic surfactant is AEROSOL-M-80 dihexyl-sulfosuccinate sodium salt available from Solvay Chemicals.

The aqueous nickel electroplating compositions of the present invention are free of any alloying metals or metals which can be included in metal plating baths to brighten or improve the luster of the nickel metal deposit.

In addition, the aqueous nickel electroplating compositions of the present invention are free of cyanide and cyanide compounds.

Preferably, the aqueous nickel electroplating compositions of the present invention are composed of nickel cations and corresponding counter anions from one or more nickel salts, a thiourethane having a formula:

(I)

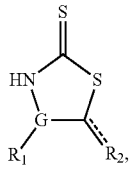

wherein $R_1$ and $R_2$ are independently chosen from hydrogen, linear or branched $(C_1\text{-}C_6)$alkyl, linear or branched hydroxy $(C_1\text{-}C_6)$alkyl, linear or branched carboxy$(C_1\text{-}C_6)$alkyl, linear or branched amino$(C_1\text{-}C_6)$alkyl, or $R_2$ can be sulfur, and G is carbon or nitrogen, and salts of the thiourethanes, optionally chloride anions and corresponding counter cations from one or more chloride salts, optionally one or more pH adjusting agents, optionally one or more surfactants, and water.

More preferably, the aqueous nickel electroplating compositions of the present invention are composed of nickel cations and corresponding counter anions from one or more nickel salts, a thiourethane having a formula:

(I)

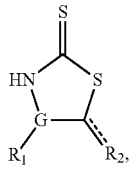

wherein $R_1$ and $R_2$ are independently chosen from hydrogen, linear or branched $(C_1\text{-}C_3)$alkyl, linear or branched hydroxy$(C_1\text{-}C_3)$alkyl, linear or branched carboxy$(C_1\text{-}C_3)$alkyl, linear or branched amino$(C_1\text{-}C_3)$alkyl, salts of the thiourethanes, or $R_2$ is sulfur, and G is nitrogen, optionally chloride anions and corresponding counter cations from one or more chloride salts, one or more pH adjusting agents, optionally one or more surfactants, and water.

Further preferably, the aqueous nickel electroplating compositions of the present invention are composed of nickel cations and corresponding counter anions from nickel salts selected from the group consisting of nickel chloride, nickel sulfamate, nickel sulfate, and mixtures thereof, a thiourethane having the following formula:

(I)

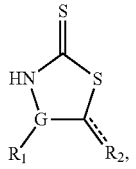

wherein $R_1$ and $R_2$ are independently chosen from hydrogen, $(C_1\text{-}C_2)$alkyl, hydroxy$(C_1\text{-}C_2)$alkyl or carboxy$(C_1\text{-}C_2)$alkyl, or $R_2$ is sulfur, and G is nitrogen, optionally chloride anions and corresponding counter cations from one or more chloride salts selected from the group consisting of nickel chloride and sodium chloride, pH adjusting agents selected from the group consisting of boric acid, lactic acid, 5-sulfosalicylic acid, salts thereof, ammonium acetate, and mixtures thereof, one or more surfactants and water.

Methods of electroplating rough nickel include providing the aqueous nickel electroplating composition and contacting the substrate with the aqueous nickel electroplating composition such as by immersing the substrate in the composition or spraying the substrate with the composition. Applying a current with a conventional rectifier where the substrate functions as a cathode and there is present a counter electrode or anode. The anode can be any conventional soluble or insoluble anode used for electroplating nickel metal adjacent a surface of a substrate. The aqueous nickel electroplating compositions of the present invention deposit nickel metal layers having rough, granular or cobblestone-like morphology on substrates.

Preferably, current densities range from 1 ASD and higher. More preferably, the current densities range from 2 ASD to 20 ASD. Further preferably, the current densities range from 5 ASD to 15 ASD.

Temperatures of the nickel electroplating compositions for depositing rough nickel, preferably, range from 30° C. to 70° C., more preferably, from 40° C. to 65° C., further preferably, from 45° C. to 60° C. Preferably, the nickel electroplating compositions are under continuous agitation during electroplating.

The thickness of the rough nickel metal layers can range from 0.5 μm and greater. Preferably, the rough nickel layers have thickness ranges of 0.5 μm to 50 μm, more preferably, from 0.5 μm to 10 μm, even more preferably, from 0.5 μm to 5 μm. Thickness of the nickel metal layers can be measured by conventional methods known in the art, such as by XRF. For example, thickness of the nickel layers can be measured using a Bowman Series P X-Ray Fluorimeter (XRF) available from Bowman, Schaumburg, IL. The XRF can be calibrated using pure nickel thickness standards from Bowman.

The nickel layers have a rough, granular or cobblestone-like or mound-like particle morphology wherein the particles, preferably, have a height of 400 nm to 700 nm and diameter at the base of, preferably, 200 nm to 600 nm, more preferably, a height of 500 nm to 700 nm and diameter at the base of 250 nm to 600 nm. The greater the thickness the greater the roughness and particle size of the nickel deposit. Such parameters can be measured using an Olympus 3D Laser Microscope-LEXT OLS5000-LAF (available from Olympus Scientific Solutions Americas). Other methods and apparatus can be used as are well known to those of ordinary skill in the art.

Preferably, the nickel layer surface has a Sa of 70 nm and greater, more preferably, 70 nm to 180 nm which is substantially equal to the Ra. Preferably, the Sdr is greater than or equal to 4%, more preferably, the Sdr is 4% to 10%. Such parameters can be measured using conventional methods known in the art such as using an Olympus 3D-laser microscope or by AFM. For example, an Olympus 3D Laser Microscope-LEXT OLS5000-LAF can be used to measure Sa and Sdr. The surface roughness can be scanned on a surface area of, for example, 256 μm×256 μm with 50× objective magnification.

The aqueous nickel electroplating compositions of the present invention can be used to deposit nickel layers on various substrates, both conductive substrates and semiconductor substrates. Preferably, the nickel layers are deposited adjacent copper, copper alloy or nickel-iron layers of substrates. Copper alloys include, but are not limited to, brass, bronze, including white bronze, copper-tin alloys and copper-bismuth alloys.

Adjacent the rough nickel layer, preferably, a noble metal is deposited such that the rough nickel layer and the noble metal have a common interface. Such noble metals include, but are not limited to, gold and palladium. Preferably, the palladium is adjacent the rough nickel forming a common interface with the rough nickel and the gold is deposited adjacent the palladium such that the gold and the palladium have a common interface. Preferably, the palladium layer has a thickness range of 5 nm to 20 nm and, preferably, the gold layer has a thickness range of 0.5 nm to 5 nm. Such metal layer arrangements are referred to as PPF and are common to leadframes. Such leadframes are encapsulated in an EMC.

The rough nickel layers enable improved bonding between the substrate, such as a leadframe and EMC. The rough nickel also improves gold wire bonding to the PPF surface. The rough nickel surface increases the contact area between the leadframe and EMC and the contact area between the leadframe and the bonding wire.

IC packages which include the rough nickel layers of the present invention enable good adhesion with epoxy molding compounds to prevent delamination of molding compounds and can be expected to have MSL-1 compliance (Moisture Sensitivity Level −1, 85° C. & 85% relative humidity for 168 hours, IPC/JEDC J-STD-20).

The following examples are included to further illustrate the invention but are not intended to limit its scope.

Example 1

Hull Cell Test

The following two aqueous nickel electroplating baths were prepared:

TABLE 1

(Invention)

| Component | Amount |
|---|---|
| Nickel sulfamate | 300 g/L |
| Nickel chloride | 30 g/L |
| Boric acid | 40 g/L |
| 2,5-dimercapto-1,3,4-thiadiazole | 50 ppm |
| Water | balance |

TABLE 2

(Comparative)

| Component | Amount |
|---|---|
| Nickel sulfamate | 300 g/L |
| Nickel chloride | 30 g/L |
| Boric acid | 40 g/L |
| Water | balance |

Hull cell tests were conducted using the following working parameters: applied current 5 A for 3 min, at 55° C., 4 LPM air agitation. Current densities ranged from 2 ASD to 20 ASD along the length of the Hull cell panels. The bath pH of the nickel bath of Table 1 was 1.31 and the pH of the nickel bath of Table 2 was 1.25 during plating. The Hull cell panels were of bronze (copper-zinc alloy). The panels were initially cleaned by electrocleaning with RONACLEAN™ GP-300 (available from DuPont de Nemours, Inc.) electrocleaning solution at 60 g/L at 4-6v for 30 sec at 60° C. and were then activated with a pre-dip solution ACTRONAL™ 988 solution (available from DuPont de Nemours, Inc.) 100 g/L at room temperature for 5 sec. After plating, the panels were rinsed with DI water and air dried at room temperature. The thickness of each panel was measured by Bowman Series P X-Ray Fluorimeter (XRF) at 10ASD which is one of the most common current densities in real production line applications. The XRF was calibrated using pure nickel thickness standards from Bowman. Nickel thickness at 10 ASD plated from the nickel bath of Table 1 (invention) and Table 2 (comparative) was 5.15 μm and 5.43 μm, respectively.

The panels plated with the nickel bath of the invention had a matte appearance at current densities from 2-10 ASD with some haze at the edge of the panels. In contrast, the panels plated with the comparative nickel bath had an uneven surface with haze and a slight reflection at all current densities from 2-20 ASD.

The roughness of the nickel layers for each panel was measured by an Olympus 3D Laser Microscope-LEXT OLS5000-LAF. The surface roughness was scanned on a surface area of 256 μm×256 μm with 50× objective magnification at 10 ASD point on the Hull cell panels. The surface roughness was characterized by area roughness index including Sa (arithmetical mean height) and Sdr (developed interfacial area ratio). Sa is substantially equivalent to Ra (arithmetic mean deviation) in profile roughness; while Sdr corresponds to the surface ratio used in industry, with a correlation of Sdr=(surface ratio−1)×100%. The higher the Sa or Sdr the greater the roughness of the nickel deposits. The average Sa for the nickel layers plated from the bath of the invention was 0.308 μm and the average Sdr was 29.68%. In contrast, the nickel layers plated from the bath of the comparative had an average Sa of 0.068 μm and an average Sdr of 4.71%. The nickel layers plated from the nickel plating bath of the invention had a significant increase in surface roughness over the nickel layers plated from the comparative bath.

Example 2

Hull Cell Test

The following two aqueous nickel electroplating baths were prepared:

TABLE 3

(Invention)

| Component | Amount |
|---|---|
| Nickel sulfamate | 300 g/L |
| Nickel chloride | 30 g/L |
| Ammonium acetate | 38.5 g/L |
| 2,5-dimercapto-1,3,4-thidiazole | 50 ppm |
| Water | balance |

TABLE 4

(Comparative)

| Component | Amount |
|---|---|
| Nickel sulfamate | 300 g/L |
| Nickel chloride | 30 g/L |
| Ammonium acetate | 38.5 g/L |
| Water | balance |

Hull cell tests were conducted using the following working parameters: applied current 5 A for 3 min, at 55° C., 4 LPM air agitation. Current densities ranged from 2 ASD to 20 ASD along the length of the Hull cell panels. The bath pH of the nickel bath of Table 3 was 4.05 and the pH of the nickel bath of Table 4 was 4.40 during plating. The Hull cell panels were of bronze (copper-zinc alloy). The panels were initially cleaned by electrocleaning and were then activated with a pre-dip solution as in Example 1 above. After plating, the panels were rinsed with DI water and air dried at room temperature. The thickness of each panel was measured by XRF as in Example 1 above. The nickel deposit thickness plated at 10 ASD from the bath of Table 3 (invention) was 5.16 μm and from the nickel bath of Table 4 (comparative) was 5.79 μm.

The panels plated with the nickel bath of the invention had a matt dull appearance at current densities of 2-20ASD with bright appearance at the edges at current densities of 0-2 ASD. In contrast, the panels plated with the comparative nickel bath had a haze at current densities below 10ASD and appeared semi-bright at current densities from 10-20ASD.

The roughness of the nickel layers for each panel was measured by an Olympus 3D Laser Microscope at 10 ASD point on the Hull cell panels as described in Example 1 above. The surface roughness was characterized by area roughness index including Sa (arithmetical mean height) and Sdr (developed interfacial area ratio). The average Sa for the nickel layers plated from the bath of the invention was 0.289 μm and the average Sdr was 32.12%. In contrast, the nickel layers plated from the bath of the comparative had an average Sa of 0.073 μm and an average Sdr of 2.47%. The nickel layers plated from the nickel plating bath of the invention had a substantial increase in surface roughness over the nickel layers plated from the comparative bath.

Example 3

Beaker Test

A plurality of copper alloy C194 coupons were used with a plating area of 2.7 cm×3 cm. The C194 coupons are a type of semiconductor material used to form lead-frames. The C194 coupons were composed of copper (≥97%), iron (2.1-2.6%), phosphorous (0.015-0.15%) and zinc (0.05-0.2%). Each coupon was pretreated as in Examples 1-2 above prior to nickel electroplating.

The following two aqueous nickel electroplating baths were prepared:

TABLE 5

(Invention)

| Component | Amount |
|---|---|
| Nickel sulfamate | 300 g/L |
| Nickel chloride | 30 g/L |
| Boric acid | 40 g/L |
| 2,5-dimercapto-1,3,4-thiadiazole | 50 ppm |
| Water | balance |

TABLE 6

(Comparative)

| Component | Amount |
|---|---|
| Nickel sulfamate | 300 g/L |
| Nickel chloride | 30 g/L |
| Boric acid | 40 g/L |
| Water | balance |

During the electroplating, the temperature was kept at 60° C., pH was 3.5 and paddle movement distance and speed was 8 cm×30 cycles/min. The applied current density was set at 1, 5, 10, 20ASD. The target nickel coating thickness was 0.75 μm; however, when the current density was 10ASD, the nickel coating was also 1.5 μm or 3.0 μm on some of the coupons. The coating thickness was examined by XRF. The coating roughness was measured by Olympus 3D Laser Microscope at the points of 1, 5, 10 and 20ASD. The grain morphology was characterized by SEM using a Zeiss Sigma 300, 20 KV, at a working distance of 10 cm.

The coupons which were nickel plated from the bath which did not include 2,5-dimercapto-1,3,4-thiadiazole were dull or semi-bright with a low roughness. In contrast, the coupons nickel plated from the baths containing 2,5-dimercapto-1,3,4-thiadiazole had matt coatings with significantly increased rough surfaces. The average Sa and Sdr values for the coupons plated to a thickness of 0.75 μm with nickel are in Tables 7 and 8.

TABLE 7

Average Sa Values

| Nickel Bath | 1 ASD | 5 ASD | 10 ASD | 20 ASD |
|---|---|---|---|---|
| Table 5 | 0.056 μm | 0.066 μm | 0.083 μm | 0.093 μm |
| Table 6 | 0.056 μm | 0.052 μm | 0.06 μm | 0.054 μm |

TABLE 8

Average Sdr Values

| Nickel Bath | 1 ASD | 5 ASD | 10 ASD | 20 ASD |
|---|---|---|---|---|
| Table 5 | 1.069% | 3.649% | 6.11% | 8.111% |
| Table 6 | 0.903% | 0.779% | 1.104% | 0.87% |

The average Sa and Sdr values for the coupons plated to a thickness of 1.5 μm and 3 μm with nickel at 10 ASD are in Tables 9 and 10.

TABLE 9

Average Sa Values

| Nickel Bath | 1.5 μm Nickel Layer | 3 μm Nickel Layer |
|---|---|---|
| Table 5 | 0.096 μm | 0.155 μm |
| Table 6 | 0.068 μm | 0.065 μm |

TABLE 10

Average Sdr Values

| Nickel Bath | 1.5 μm Nickel Layer | 3 μm Nickel Layer |
|---|---|---|
| Table 5 | 8.8913% | 13.451% |
| Table 6 | 1.62% | 2.377% |

Example 4

Button Shear Test and Wire Bonding Test

Leadframe substrates of C194 copper-alloy with dimensions of 6 mm×27 mm was pretreated by electrocleaning and pre-dip as in Example 1 above. The leadframes were electroplated in the rough nickel bath of Table 1 of Example 1 or the comparative nickel bath of Table 11.

TABLE 11

| Component | Amount |
|---|---|
| Nickel sulfamate | 300 g/L |
| Nickel Chloride | 7.5 g/L |
| Boric acid | 45 g/L |
| NICKAL ™ SC wetting agent[1] | 10 mL/L |

[1]Available from DuPont de Nemours, Inc. Wilmington, DE.

Figure 2:
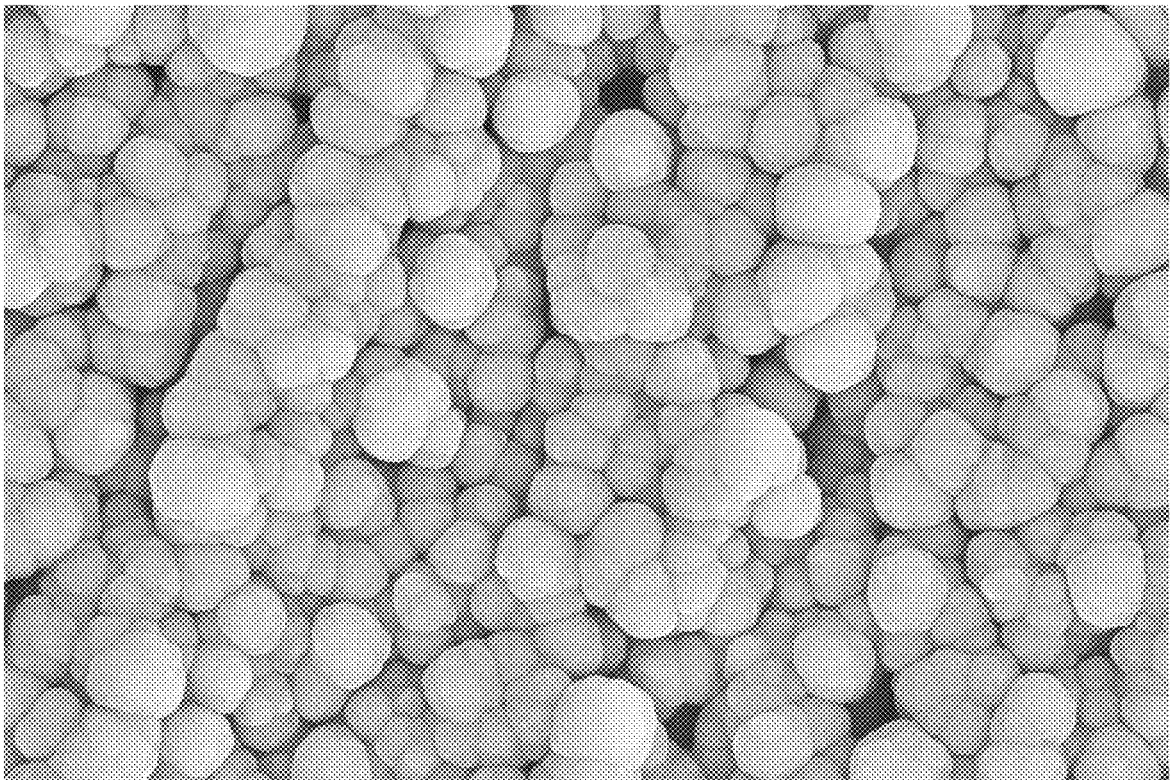
FIG. 2 is a SEM at 10,000× of a rough nickel layer electroplated from a nickel bath of the present invention showing cobblestone type morphology.

Nickel electroplating was done at 10 ASD for 30 seconds. The pH of the nickel plating baths were maintained at 3.5 during electroplating. The temperature of each bath was kept at 60° C. A nickel layer of 0.75 μm was deposited on the copper alloy of the leadframes. The thickness of the nickel layers was measured by XRF. The comparative nickel deposit had a morphology as shown in FIG. 1 and the rough nickel deposit had a morphology as shown in FIG. 2. The grain morphology was characterized by SEM using a Zeiss Sigma 300, 20 KV, at a working distance of 10 cm and 10,000 X. The nickel deposit of FIG. 2 shows the characteristic cobblestone nickel deposit from the nickel plating baths of the invention. In contrast, FIG. 1 shows a substantially smoother nickel deposit characteristic of many conventional nickel baths.

The surface roughness of the nickel deposits was characterized by area roughness index Sa (arithmetical mean height) and Sdr (developed interfacial area ratio). The coating roughness was measured by Olympus 3D Laser Microscope. The average Sa for the nickel layers plated from the bath of the invention was 0.11 μm and the average Sdr was 8.32%. In contrast, the nickel layers plated from the bath of the comparative had an average Sa of 0.095 μm and an average Sdr of 1.03%.

Palladium layers were then plated on the nickel layers using PALLADURE™ 200 palladium electroplating bath (available from DuPont de Nemours, Inc.) at 0.75 ASD for 3 seconds. The bath temperature was at 45° C. The palladium layer on each nickel layer was 10 nm. A gold layer having a thickness of 3 nm was then plated on the palladium layer with AURALL™ 364 gold strike bath (available from DuPont de Nemours, Inc.). The gold plating was done at 0.1 ASD for 15 seconds at 45° C. The PPF multilayer structure had layers of Ni 0.75 μm/Pd 10 nm/Au 3 nm.

A gold bonding wire with a diameter of 25 μm (Heraeus AW-14) was solder bonded on the comparative and rough nickel PPF surface mentioned above using K&S manual wire bonder Model 4524. Adhesive strength of each type of nickel deposit was then tested by the button shear test and the wire pull strength and the wire pull failure mode test.

All the coupons were then coated with molding compound EMC-G700LA (Sumikon bakelite Co. Ltd). To avoid unexpected curing, the EMC was stored at −40° C. and was taken out from the freezer 24 hours before the molding process. During the de-freeze process, the EMC was kept under vacuum to minimize moisture absorption. The molding compound was molded into a button shape and cured at 175° C. in a conventional oven for 2 min. The coupons with the button shaped molding compound were then post-mold cured at 175° C. for 4 hours. The coupons were cooled to room temperature. Half of the coupons with the button shaped molding underwent exposure to Moisture Sensitivity Level-1, 85° C. & 85% relative humidity for 168 hours using ESPEC bench-top type Temperature & Humidity Chamber, model SH-221. The coupons were placed in a stainless steel basket in the chamber and set at 85° C. at relative humidity of 85% for the 168 hours (7 days). The coupons were then removed from the chamber and dried in the ambient environment. The button shear test was then done on all the coupons. The button shear test conditions are below:

a) Shear equipment: Nordson Dage 4000 multipurpose bond tester b) Cartridge: DS 100 c) Button height: 3 mm d) Button diameter: 3-3.5 mm e) Shear height: 20% of button=600 μm f) Shear speed: 85 μm/second g) Temperature: Room temperature The results of the button shear test for the comparative nickel PPF coupons and the rough nickel PPF coupons are in Table 12 below.

TABLE 12

| Treatment | Rough Nickel Average Shear Force (Kg) | Comparative Nickel Average Shear Force (Kg) |
|---|---|---|
| W/O MSL-1 | 17.9 | 13.5 |
| W/MSL-1 | 11.8 | 8.6 |
| Diff. % of Shear Force | −34% | −36% |

The decline in the shear force for the rough nickel of the present invention was similar to the decline in the shear force for the comparative nickel but the rough nickel of the present invention had improved adhesion over the comparative nickel with or without MSL-1 treatment.

The Nordson Dage 4000 multipurpose bond tester was used in the wire pull test (Cartridge WP100, test speed 200 μm/second). During the wire pull and wire pull failure mode test, the crack failure modes were stitch break and neck break. Neck break for the comparative nickel PPF was 84.6% in failure mode and stitch break was 15.4% in failure mode. In contrast, neck break for the rough nickel PPF was 78.9% in failure mode and stitch break was 21.1% in failure mode. The wire pull and wire pull failure modes test were done according to IPC-TM-650 Test Methods Manual, Number 2.4.42.3, February 1998 (Originating Task Group MCM-L Substance Performance Task Group (D-33e)), available from The Institute for Interconnecting and Packaging Electronic Circuits 2215 Sanders Road Northbrook, IL 60062-6135). The results are shown in Table 13.

TABLE 13

| Wire Pull | Rough Nickel | Comparative Nickel |
|---|---|---|
| Strength (average in grams) | 4.63 | 5.70 |
| Failure Mode | Mode B: neck Break 78.9% Mode D: stitch Break 52.2% | Mode B: neck Break 84.6% Mode D: stitch Break 15.4% |

Both neck break and stich break of the rough nickel are acceptable in the industry. The wire pull strength for the rough nickel PPF did not significantly decrease. This was unexpected because rough surfaces are expected to decrease pull strength and gold wire is not expected to bond to a rough surface. The wire pull strength can be further optimized by adjusting the wire bonder and working parameters.

What is claimed is:

1. A method of electroplating nickel metal on a substrate:

a) providing the substrate;

b) contacting the substrate with a nickel electroplating composition, wherein the nickel electroplating composition comprises nickel ions and a thiourethane having a formula:

(I)

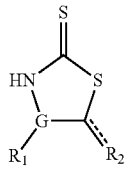

wherein $R_1$ and $R_2$ are independently chosen from hydrogen, linear or branched hydroxy ($C_1$-$C_6$)alkyl, linear or branched carboxy ($C_1$-$C_6$)alkyl, linear or branched amino ($C_1$-$C_6$)alkyl, ($C_5$-$C_6$)cycloalkyl ring, or $R_2$ can be sulfur, and G is carbon or nitrogen, and salts of the thiourethanes, the nickel electroplating composition is free of alloying metals; and c) depositing a nickel layer on the substrate, wherein the nickel layer comprises a Sa ≥70 nm and a Sdr≥4%.

2. The method of claim 1, wherein the thiourethane has a formula:

(II)

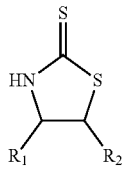

wherein $R_1$ and $R_2$ are independently chosen from hydrogen, linear or branched ($C_1$-$C_6$)alkyl, linear or branched hydroxy ($C_1$-$C_6$)alkyl, linear or branched carboxy ($C_1$-$C_6$)alkyl, linear or branched amino ($C_1$-$C_6$)alkyl, and salts of the thiourethanes.

3. The method of claim 1, wherein the thiourethane has the following formula:

(III)

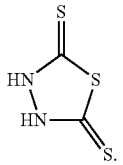

4. The method of claim 1, wherein the thiourethane is in amounts of 5 ppm or greater.

5. The method of claim 4, wherein the thiourethane is in amounts of 10 ppm to 100 ppm.

6. The method of claim 1, wherein a source of nickel ions is selected from the group consisting of nickel sulfate, nickel sulfate hexahydrate, nickel sulfate heptahydrate, nickel sulfamate, nickel sulfamate tetrahydrate, nickel chloride, nickel chloride hexahydrate, nickel carbonate, nickel methane sulfonate, nickel bromide, nickel fluoride, nickel iodide, nickel oxalate, nickel citrate, nickel tetrafluoroborate, nickel hypophosphite, nickel acetate and mixtures thereof.

7. The method of claim 1, further comprising a source of chloride ions.

8. The method of claim 7, wherein the source of chloride ions is selected from the group consisting of nickel chloride, nickel chloride hexahydrate, hydrogen chloride, sodium chloride, potassium chloride, magnesium chloride, calcium chloride, ammonium chloride, guanidine hydrochloride, ethylenediamine dihydrochloride, trimethylammonium chloride, pyridine hydrochloride, phenylammonium chloride, hydrazine dihydrochloride and mixtures thereof.

9. The method of claim 1, wherein a pH of the nickel electroplating composition is from 2 to 6.

10. The method of claim 1, further comprising a pH adjusting agent.

11. The method of claim 10, wherein the pH adjusting agent is selected from the group consisting sulfuric acid, hydrochloric acid, sulfamic acid, boric acid, acetic acid, amino acetic acid, ascorbic acid, lactic acid, 5-sulfosalicylic acid and salts thereof.

12. The method of claim 1, further comprising a surfactant.

13. The method of claim 12, wherein the surfactant is selected from the group consisting of sodium di(1,3-dimethylbutyl) sulfosuccinate, sodium-2-ethylhexylsulfate, sodium diamyl sulfosuccinate, sodium lauryl sulfate, sodium lauryl ether-sulfate, sodium di-alkylsulfosuccinates and sodium dodecylbenzene sulfonate, perfluorinated quaternary amines and mixtures thereof.

14. The method of claim 1, wherein the nickel electroplating composition is free of cyanide compounds.

* * * * *